United States Patent [19]

Yamaguchi et al.

[11] Patent Number: 4,941,443

[45] Date of Patent: Jul. 17, 1990

[54] GOVERNOR DEVICE FOR AN ENGINE

[75] Inventors: Fumihiro Yamaguchi; Yoshiaki Sayama; Takao Nishida, all of Saitama, Japan

[73] Assignee: Honda Giken Kogyo Kabushiki Kaisha, Tokyo, Japan

[21] Appl. No.: 304,064

[22] Filed: Jan. 27, 1989

[30] Foreign Application Priority Data

| | | | |
|---|---|---|---|
| Jan. 26, 1988 | [JP] | Japan | 63-015627 |
| Jan. 26, 1988 | [JP] | Japan | 63-015626 |
| Jul. 22, 1988 | [JP] | Japan | 63-183223 |
| Jul. 22, 1988 | [JP] | Japan | 63-183224 |
| Jul. 22, 1988 | [JP] | Japan | 63-183225 |

[51] Int. Cl.[5] ..... F02D 9/10

[52] U.S. Cl. ..... 123/376; 123/319; 123/396

[58] Field of Search ..... 123/319, 372, 373, 376, 123/396, 400, 401, 403

[56] References Cited

U.S. PATENT DOCUMENTS

| | | | |
|---|---|---|---|
| 4,640,245 | 2/1987 | Matsuda et al. | 123/401 X |
| 4,793,309 | 12/1988 | Huffman et al. | 123/376 |

FOREIGN PATENT DOCUMENTS

| | | |
|---|---|---|
| 49-18849 | 5/1974 | Japan . |
| 53-32008 | 9/1978 | Japan . |
| 55-22617 | 6/1980 | Japan . |
| 55-22618 | 6/1980 | Japan . |
| 56-13178 | 3/1981 | Japan . |
| 58-36224 | 8/1983 | Japan . |
| 61-207836 | 9/1986 | Japan . |
| 0690831 | 4/1953 | United Kingdom . |

*Primary Examiner*—Willis R. Wolfe

*Attorney, Agent, or Firm*—Lyon & Lyon

[57] ABSTRACT

A governor device for an engine which is simple in construction and easy to adjust, and achieves precise and reliable control of engine speed without contacting the rotating portion of the engine. The governor device consists of a non-magnetic and electrically conductive disk which is rotated in synchronism with the engine; a swing member pivotally mounted for effecting a free-swing action thereof; a magnet mounted on said swing member and providing a magnetic field onto said disk for inducing an electromagnetic force to effect said swing action of the swing member in responsive to the rotation of said disk; a spring member for suppressing said swing action of said swing member in one direction; and a drive mechanism for operating a throttle valve of the engine in opening or closing direction in responsive to the swing action of said swing member.

12 Claims, 13 Drawing Sheets

GOVERNOR DEVICE FOR AN ENGINE

BACKGROUND OF THE INVENTION

1. Field of the Invention

The present invention relates to a governor device for controlling the speed of an engine in response to the change in revolution of said engine.

2. Description of the Prior Art

A conventional governor device of centrifugal weight type has long been widely used which is arranged to effect the control of the engine speed by a displacement of a governor weight caused when the weight is subjected to a centrifugal force based upon the engine revolution.

Such conventional governor device, however, has a number of disadvantages to be solved. For example, lubrication must be performed in order to prevent a slide portion between a rotating and a non-rotating members from wearing. In addition, highly precise components and reliability of assembly are also required to achieve the stable control of the engine speed. Further, there is a limitation in amount and displacement of the governor weight, which leads to narrower range of control stroke and reduced ability of setting for driving force transmitted. Furthermore, the specific gravity of the governor weight will vary depending upon the displaced position of the governor weight due to the centrifugal force. Therefore the control characteristic of the governor device becomes significantly non-linear.

Another type of the governor arrangement is also proposed in which a torque generator to be driven by the engine is used instead of the centrifugal weight type governor. The torque generator produces a rotational torque on its stator without contacting the rotating part of the engine and the rotational torque produced is transmitted to the engine throttle valve to adjust the degree of opening thereof (Refer to Japanese Patent Publication Nos. 22617-1980 and 22618-1980).

This prior art governor arrangement, however, does not rapidly operate in response to the change in engine revolution due to its conversion scheme wherein the dynamic change in engine revolution is converted into a static change while controlling the output of said torque generator. In addition, installing of such torque generator within the engine presents certain problems such as the complication in construction and the increase in bulk.

Further the other type of the governor arrangement is developed in which in order to improve the easiness in installing the governor device in the engine, especially the overhead cam shaft type engine, the governor device of the centrifugal weight type as stated above is incorporated into the camshaft and is operated in response to the rotation thereof (Refer to Japanese Patent Laid Open No. 207836-1986).

This governor arrangement also has the disadvantages due to the centrifugal weight type governor as stated above.

More particularly, in the arrangement of the prior art governor device, because of the cooperation of the device with the rotational axis of the engine, it is installed in the body of engine itself. Referring now to FIG. 21, the degree of opening of the throttle valve 57 is adjusted by moving a link 59 mounted on the throttle axis 58 of the carburetor throttle valve 57 by a control cable 56 extending from the governor device and coupled to said link 59.

Such drive means for driving the throttle axis 58 by the link 59, however, produces a change in torque for rotating the throttle axis 58, depending upon the degree of opening of the throttle valve 57. In this regard, greater the degree of opening of the throttle valve 58, smaller the torque produced, thereby it may be insufficient to drive the throttle valve 57.

SUMMARY OF THE INVENTION

In view of the foregoings, it is an object of the present invention to provide an improved governor device for an engine that is simple in construction and easy to adjust and that achieves highly precise, stable, and linear control of engine speed with wider range of valve open/close stroke and of setting ability of drive force and without contacting the rotating portion of the engine.

It is another object of the present invention to provide such governor device that facilitates the assembly of the device into the engine.

It is further object of the present invention to provide such governor device that enables the highly precise and reliable control of the engine speed so that the rotation of the throttle axis is linearly achieved instead of depending upon the degree of opening of the throttle valve.

In order to achieve these objects, the present invention provides a governor device for an engine that enables the control of engine speed, by utilizing an electromagnetic force induced in approximate proportion to the engine revolution under the influence of the magnetic field of a magnet, and an eddy current produced thereby on a disk which is rotated in synchronism with the engine.

In the governor device according to the present invention, an electromagnetic force is induced on a non-magnetic and electrically conductive rotational member which is rotated inn synchronism with the engine under the influence of magnetic field of the permanent magnet mounted on the swing member, or it is induced on a non-magnetic swing member under the influence of magnetic field of the permanent magnet mounted on the rotational member which is rotated in synchronism with the engine, thereby causing the swing action of the swing member against the governor spring to provide speed control of the engine. This is achieved in relatively simple construction wherein said rotational member and said swing member are positioned relative to each other so that rotational axis of the rotational member is aligned with the swing axis of the swing member. Thus the governor device enables linear control of the engine speed in proportion to the engine revolution and in response to the swing action of the swing member.

Further, according to the present invention, a camshaft of the overhead camshaft type engine has a pulley mounted thereon as the rotational member and therefore an effective governor device having the reduced number of components and facilitating assembly of the device to the engine is provided.

In an alternative arrangement of the present invention, said rotational member and said swing member are positioned so that the rotational axis of the rotational member and the swing axis of the swing member are aligned with the throttle axis of the carburetor throttle valve in order to open or close the valve, and the swing axis is directly coupled to the throttle axis so that the revolution of the engine is transmitted to the rotational axis of the rotational member through the rotation transmission mechanism.

The present invention will be further described with reference to the several preferred embodiments as shown in the accompanying drawings in which:

FIGS. 1(*a*) and (*b*) are plane and sider cross-sectional views, respectively, showing one embodiment of the engine governor device according to the present invention;

FIGS. 2(*a*) and (*b*) are front and side views, respectively, showing other embodiment of the engine governor device according to the present invention with the device installed in the engine;

FIG. 3(*a*) is a cross-sectional view showing the governor device for an engine according to the present invention;

FIG. 3(*b*) is a plane view showing only essential portions of the device in FIG. 3(*a*);

FIGS. 4(*a*) and (*b*) are plane and side views, respectively, showing the principal arrangement of the engine governor device according to the present invention;

FIGS. 5(*a*) and (*b*) represent the governor spring that effects a tension load depending upon the position of the swing member;

FIGS. 6(*a*) and (*b*) are plane and side views, respectively, showing another arrangement wherein the axis of the rotational member is displaced from the swing axis of the swing member;

FIGS. 7(*a*) and (*b*) represent the governor spring that effects a tension load depending upon the position of the swing member as shown in FIG. 6;

FIGS. 8(*a*) and (*b*) are plane and side views, respectively, showing other embodiment of the governor device according to the present invention;

PREFERRED EMBODIMENT OF THE INVENTION

Figure 1A:
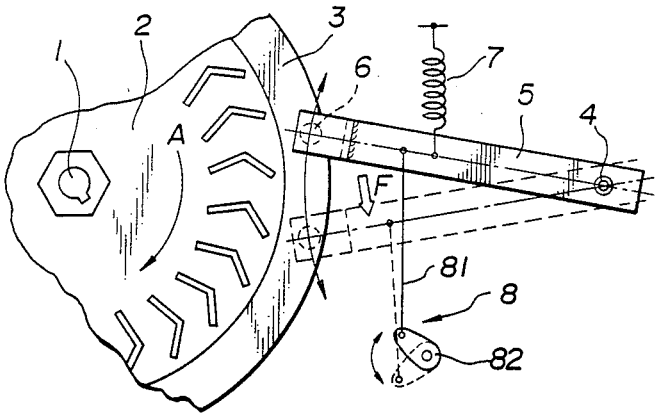
Figure 1B:
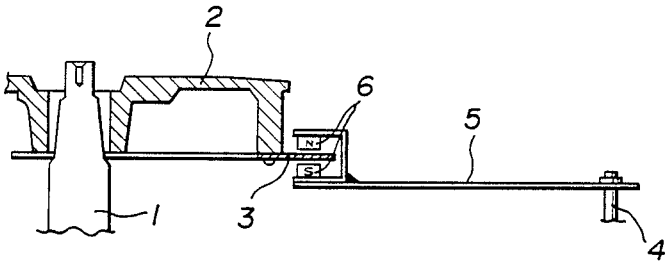

FIGS. 1(*a*) and (*b*) represent a governor device for an engine constructed in accordance with the present invention wherein the engine is the general purpose type and is provided with, for instance, a magnet type generator having a fly-wheel and a magnet. More particularly, the engine has a crank shaft 1 on which the fly-wheel 2 is mounted. The fly-wheel 2 has, on its peripheral portion, a disk 3 made of non-magnetic and electrically conductive material such as aluminum, and at a position opposite to the disk 3, a swing arm 5 is disposed with one end thereof being pivotally mounted on a pivot 4. The other end of the swing arm 5 is provided with a pair of magnets 6 which are disposed at the upper and lower sides of the disk 3 with the respective gaps therebetween. In addition, a spring 7 is mounted between the swing arm 5 and a stationary part so that the spring 7 serves to suppress the swing action of the arm 5 in the direction of rotation of the fly-wheel 2 indicated by an arrow A. In order to effect the open and close action of the throttle valve of the engine (not shown) according to the movement of the swing arm 5, a link mechanism 8 comprising link members 81 and 82 is connected between the swing arm 5 and the engine throttle valve.

In such an arrangement of the governor device according to the present invention, as the fly-wheel 2 is rotated in synchronism with the engine in the direction indicated by the arrow A, an electromagnetic force (EMF) F which causes the swin actin of the arm 5 in the same direction as that of the fly-wheel 2 is induced due to the magnetic field of the magnets 6 and an eddy current produced on the disk 3 by means of the magnets 6. The magnitude of the electromagnetic force F is approximately proportional to the number of revolution of the fly-wheel 2 and hence of the engine.

If the tension of the spring 7 is selected to be equal to the electromagnetic force F for the swing arm 5 when the engine is operated at the predetermined revolution speed, the engine throttle valve is kept at the predetermined degree of opening with the arm 5 having no swing action and kept in fixed position as long as the revolution of the engine is at the predetermined speed.

As the revolution of the engine becomes greater than the predetermined speed due to the decrease of load and the like, the electromagnetic force F on the swing arm 5 increases beyond the tension of the spring 7, and the corresponding amount of the swing action of the swing arm 5 is effected in the same direction as that of the fly-wheel 2, which is transmitted through the link mechanism 8 to operate the throttle valve in the closing direction, thereby tending to maintain the predetermined revolution speed of the engine.

With the throttle valve operated in the closing direction as stated above, if the same load condition as that of the previous one restores, then the revolution of the engine decreases and consequently the electromagnetic force F on the swing arm 5 gradually decreases until it becomes equal to the tension of the spring 7, upon which the swing arm 5 restores in position which brings back the throttle valve to the predetermined degree of opening, thereby maintaining the predetermined revolution speed of the engine.

On the other hand, as the revolution of the engine becomes lower than the predetermined speed due to the increase of load and the like, the electromagnetic force F on the swing arm 5 becomes lesser than the tension of the spring 7, and the corresponding amount of the swing action of the swing arm 5 is effected in the direction opposite to that of the fly-wheel 2, which is also transmitted through the link mechanism 8 to operate the throttle valve in the opening direction, thereby tending again to maintain the predetermined revolution speed of the engine.

With the throttle valve operated in the opening direction in such manner, if the same load condition as that of the previous one restores, then the revolution of the engine increases and consequently the electromagnetic force F on the swing arm 5 gradually increases until it becomes equal to the tension of the spring 7, upon which the swing arm 5 restores in position which brings back the throttle valve to the predetermined degree of opening, thereby maintaining the predetermined revolution speed of the engine.

It is apparent that in the governor device according to the present invention as mentioned above, control of the throttle valve in both opening and closing directions according to the change in revolution of the engine is attained without any contact relative to the rotating portions of the engine, which precludes the possibility of wear of them. Furthermore, irrespective to such contactless configuration, control of the throttle valve in opening and closing directions is directly effected in response to the change in revolution of the engine, rather than indirectly by converting the dynamic change in revolution of the engine into the static change in some form, thereby enabling rapid control of the throttle valve.

In addition, in the governor device according to the present invention, there are no problems regarding to the shift in position of the center of gravity which usually found in the conventional governor device of centrifugal weight type. Therefore, according to the present invention, an approximately linear and proportional relationship exists between the magnitude of the electromagnetic force F on the swing arm 5 and the swing position of the swing arm 5, thereby achieving the improved control of the operation of the throttle valve in opening and closing directions with the highly stable control characteristics.

Furthermore, the governor device according to the present invention does not require the high precision of assembling steps and the great number of component parts, but can achieve the precise and stable control of the throttle valve in opening and closing directions depending on the increase and decrease of the engine revolution speed by only performing some adjustments. For example, wide ranges of the driving force and the stroke in order to control the opening and closing of the throttle valves can be obtained by only displacing the connecting point of the link 81 and the swing arm 5 to any longitudinal position thereon.

It is to be noted that in the embodiment disclosed here, because the fly-wheel 2 made of steel material used, the disk 3 made of non-magnetic material such as aluminum is separately mounted thereon. Alternatively the fly-wheel 2 may be made of non-magnetic material such as cast aluminum and in such case it is possible to integrally form both the fly-wheel 2 and the disk 3.

Figure 2A:
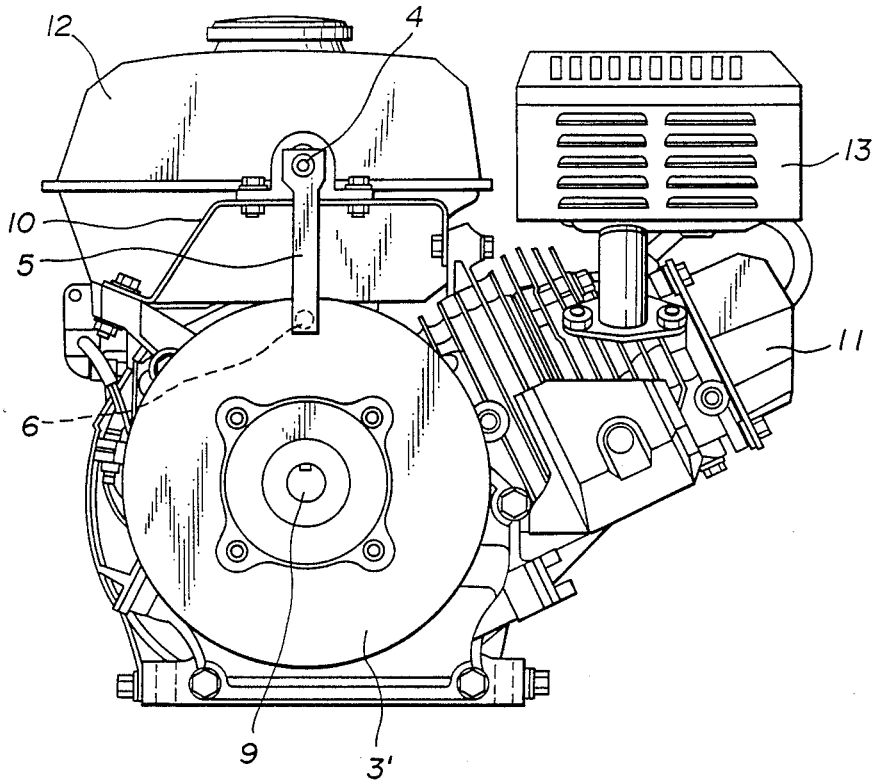
Figure 2B:
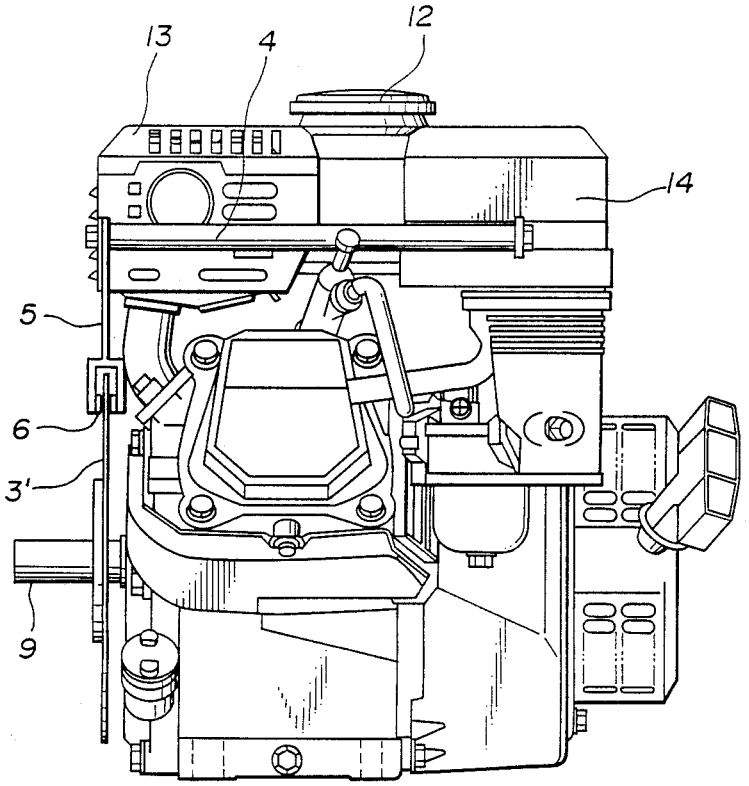

FIGS. 2(*a*) and (*b*) represent another embodiment of the present invention in which the preexisting fly-wheel is not utilized as in the case of the first embodiment described above and a discrete disk 3' made of non-magnetic material su-ch as aluminum is separately mounted on the shaft 9 of the engine. In addition, the swing arm 5 is mounted at its one end to the pivot 4 which is then mounted to the engine body by means of a support 10. It is to be noted that in these figures, for the clarity of the illustration, the spring for suppressing the swing action of the swing arm 5 in one direction and the link mechanism for opening and closing the engine throttle valve are omitted. In actual case, however, an arm plate is mounted to, and arranged to move together with, another end of the swing arm 5 opposite to said one end wherein the arm 5 is pivotally connected to the pivot 4. Then, in the same manner as that described above, the spring and the link mechanism are attached to this arm plate. Reference numeral 11 represents a cylinder head of the engine, reference numeral 12 represents a fuel tank, reference numeral 13 represents a muffler and reference numeral 14 represents an air cleaner.

Figure 3A:
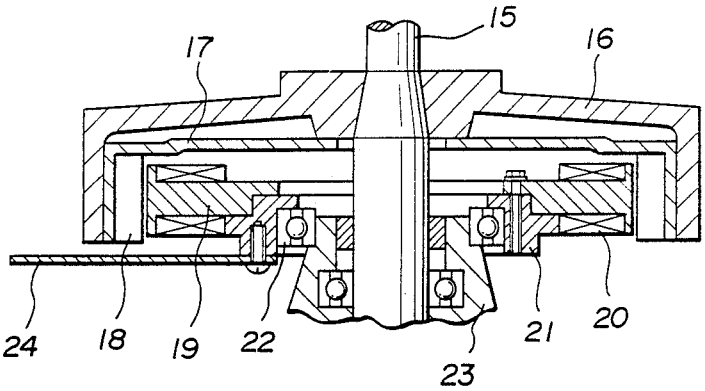
Figure 3B:
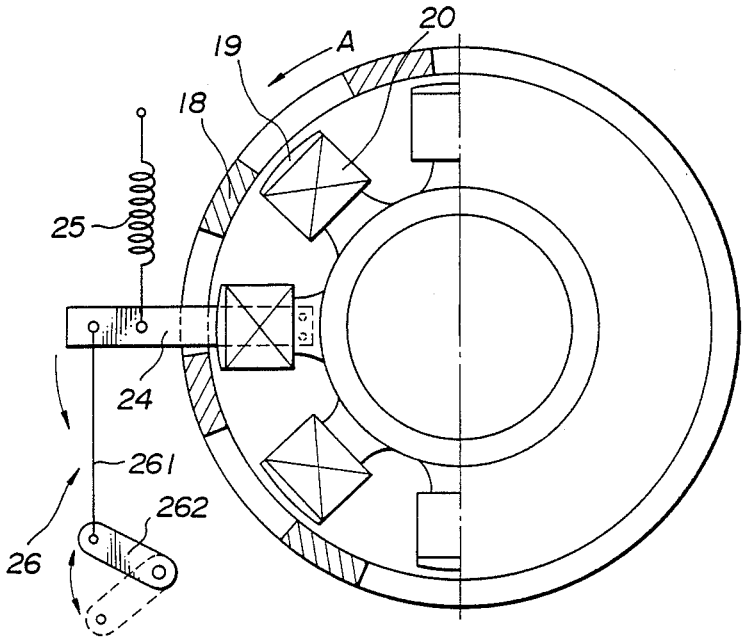

FIGS. 3(*a*) and (*b*) represent further embidiment of the present invention in which the engine includes a fly-wheel/magnet type generator comprising a multi-pole (for example, eight-pole) rotor and a multi-pole (for example, eight-pole) salient stator. Said rotor consists of a fly-wheel 16 made of cast alminium which is attached to the engine crank shaft 15, an attachment member 17 for producing a magnetic circuit, and a plurality of magnets 18 mounted to the fly-wheel through the attachment member 17. And said stator consists of a plurality of cores 19 each arranged to form a predetermined gap relative to each magnet 18, and a plurality of windings 20 each provided on one core 19. More particularly, the stator is mounted to a stationary boss 23 through a retainer member 21 made of, for example, cast aluminium and a bearing 22 in order to freely rotate the stator coaxially with the crank shaft 15. An arm 24 made of, for example, SP material is attached to the retainer member 21 and is extending therefrom beyond the peripheral portion of the fly-wheel 16. A spring 25 is attached to the arm 24 and the some stationary part so that it serves to suppress the swing of the arm 24 in the same direction as that of the fly-wheel 16 indicated by an arrow A. In order to operate the throttle valve (not shown) of the engine in the opening and closing directions according to the swing action of the arm 24, a link mechanism 26 consisting of link means 261 and 262 is connected between the arm 24 and the engine throttle valve.

In such arrangement of the governor device according to the embodiment mentioned above, as the fly-wheel 16 is rotated in synchronism with the engine in the direction indicated by an arrow A, an eddy current is induced on the end surfaces of the cores 19 due to the magnetic flux produced by the magnets 18. Then the eddy current, in combination with the magnetic field of the magnets 18, produces an electromagnetic force which causes the cores 19 to be rotated in the same direction as that of the fly-wheel 16. The magnitude of the electromagnetic force is approximately proportional to the number of revolution of the fly-wheel 16 and hence of the engine.

In this embodiment, the cores 169 are arranged to have end surfaces of larger area in order to produce higher eddy current thereon.

If the tension of the spring 25 is selected to be equal to the swing force on the cores 19 when the engine is operated at the predetermined revolution speed, the revolution speed of the engine is controlled in accordance with the swing action of the arm 24 as in the embodiment described in conjunction with FIG. 1.

Further, in this embodiment of the invention, in addition to the advantageous effects provided in said embodiment shown in FIG. 1, a remarkable characteristic is also attained wherein the predetermined number of revolution of the engine can be maintained even when there is larger change in electrical load of the generator, by adaptively operating the throttle valve in opening or closing direction before the change in load current passing through the windings 20 is reflected as the change in load torque of the engine.

In regard to this embodiment, an alternative arrangement may be taken in which the swing arm 24 is removed and instead a swing portion of the stator is directly connected to one end of the link mechanism for operating the throttle valve in opening and closing directions. In such case, said swing portion of the stator must have the spring connected therewith for suppressing it from swinging in the same direction as that of the fly-wheel 16. Furthermore, a stator other than salient type stator as mensioned above may be used.

Figure 4A:
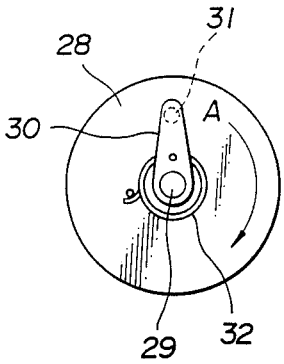
Figure 4B:
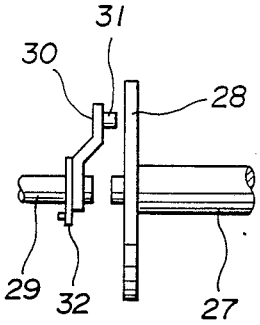

FIGS. 4(*a*) and (*b*) represent a further embodiment of the governor device for an engine according to the present invention wherein it comprises a disk 28 made of non-magnetic and electrically conductive material such as aluminum which is mounted on a rotational axis 27 such as a crank axis or a cam axis which is rotated in synchronism with the engine, and a swing member 30 which is disposed in opposite to said disk 28 and has a swing axis 29 aligned to said rotational axis 27. A permanent magnet 31 is mounted on one end portion of the swing member 30 with a gap remained relative to the disk 28. A governor spring 32 of torsion coil type is wound around the swing axis 29 and is connected to the swing member 30 and a stationary part so that the spring serves to suppress the swing action of the swing member 30 in the same direction as that of the disk 28 indicated by an arrow A.

Although not shown in the drawings, an alternative arrangement may be taken wherein the swing axis 29 of the swing member 30 is used as the shaft of the governor for controlling the engine speed and the swing force on the swing axis 29 is transmitted through the link mechanism to adaptively adjust the degree of opening of the throttle valve.

In such arrangement, as the disk 28 is rotated in the direction indicated by the arrow A in synchronism with the engine, an eddy current is induced on the disk 28 under the influence of the magnetic field of the permanent magnet 31 and the eddy current, in combination with the magnetic field of the permanent magnnt 31, produces an electromagnetic force for causing the swing member 30 to be swang in the same direction as that of the disk 28. The amount of the electromagnetic force is approximately proportional to the number of revolution of the disk 28 and thus of the engine.

If the tension of the governor spring 32 is selected to be equal to the swing force on the swing member 30 when the engine is operated at the predetermined revolution speed, the engine throttle valve is kept at the predetermined degree of opening with the arm 30 having no swing action and kept in fixed position as long as the revolution of the engine is at the predetermined speed.

As the revolution of the engine becomes greater than the predetermined speed due to the decrease of load and the like, the swing force on the swing member 30 increases over the tension of the spring 32, and the corresponding amount of the swing action of the swing member 30 is effected on the same direction as that of the disk 28, thereby operating the throttle valve in the closing direction in order to maintain the predetermined revolution speed of the engine.

With the throttle value operated in the closing direction as stated above, if the previous load condition restores, then the revolution of the engine decreases and consequently the swing force on the swing member 30 gradually lowers until it becomes equal to the tension of the governor spring 32, upon which the swing member 30 restores in position which brings back the throttle valve to the predetermined degree of opening, thereby maintaining the predetermined revolution speed of the engine.

On the other hand, as the revolution of the engine becomes lower than the predetermined speed due to the increase of load and the like, the swing force on the swing member 30 becomes lesser than the tension of the governor spring 32, and the corresponding amount of the swing action of the swing member 30 is effected in the direction opposite to that of the disk 28, thereby operating the throttle valve in the opening direction in order to again maintain the predetermined revolution speed of the engine.

With the throttle valve operated in the opening direction in this manner, if the previous load condition restores, then the revolution of the engine increases and consequently the swing force on the swing member gradually increases until it becomes equal to the tension of the governor spring 32, upon which the swing member 30 restores a position which brings back the throttle valve to the predetermined degree of opening, thereby maintaining the predetermined revolution speed of the engine.

As mentioned above, according to the embodiment as stated above, the disk 28 and the swing member 30 are positioned such that the rotational axis 27 of the disk 28 and the swing axis 29 of the swing member 30 are aligned relative to each other. Therefore, the swing member 30 is made swing in the same direction as that of the disk 28, thereby achieving the swing force on the swing axis 29 in proportional to the revolution of the engine irrespective of the position of the swing member 30.

Figure 6A:
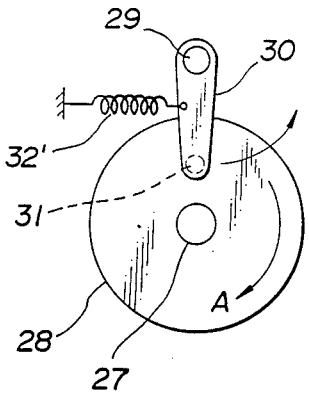
Figure 6B:
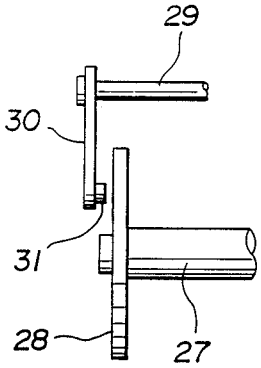

FIGS. 6(*a*) and (*b*) represent another arrangement in which the swing member 30 is positioned such that the swing axis 29 is not aligned to and displaced from the rotational axis 27 of the disk 28. In such arrangement, direction of rotation of the disk 28 and the swing direction of the swing member 30 does not match to each other. Consequently the swing force having some angular component is produced on the swing member 30 under the influence of the electromagnetic force of the permanent magnet. Therefore, the torque tending to rotate the swing axis 29 will be changed depending upon the position of the swing member 30, which leads to failure of the linear proportional control characteristic regarding the revolution of the engine. In this respect, there is an additional problem in which the permanent magnet 31 is not opposed to the disk 28 depending on the position of the swing member 30 due to the fact that the rotational axis 27 is displaced from the swing axis 29.

Figure 5A:
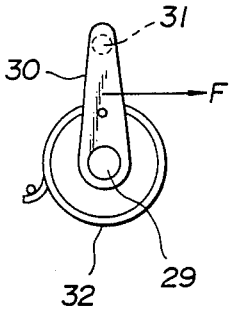
Figure 5B:
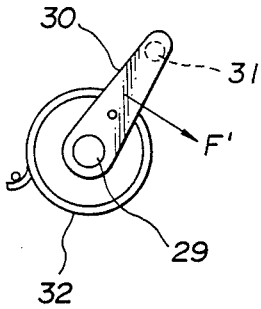
Figure 7A:
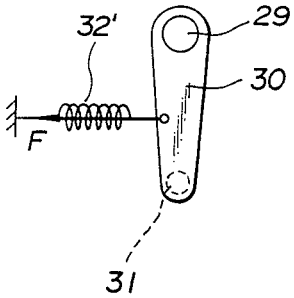
Figure 7B:
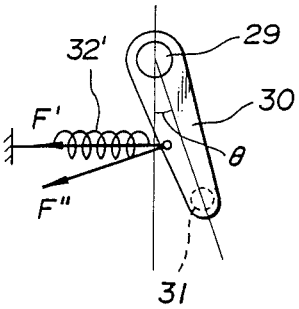

Referring to FIGS. 5 and 7, the difference in operation between two arrangements shown in FIGS. 4 and 6 will be described. As stated above, according to the arrangement in FIG. 4, the governor spring 32 of torsion coil type is wound around the swing axis 29 and connected to the swing axis 29 and the stationary part of the device. Thus as shown in FIGS. 5(*a*) and (*b*), a spring load in proportion to the swing angle of the swing member 30 is applied thereon and hence a linear control characteristic in proportion to the revolution of the engine is achieved. In these drawings, reference characters F and F' represent tension of the governor spring 32 each depending on the position of the swing member 30.

On the other hand, in the arrangement shown in FIG. 6(*a*), a spring 32′ is connected between the swing arm 30 and the stationary part of the device. Thus as shown in FIGS. 7(*a*) and (*b*), the different tension of the spring 32′ including angular component based on the angle $\theta$ is applied to the swing arm 30 depending upon the position thereof, so that the spring load applied to the swing arm 30 is not in proportion to the swing angle of the swing member 30, thereby leading to failure of hte linear proportional control characteristic of the governor.

Figure 8A:
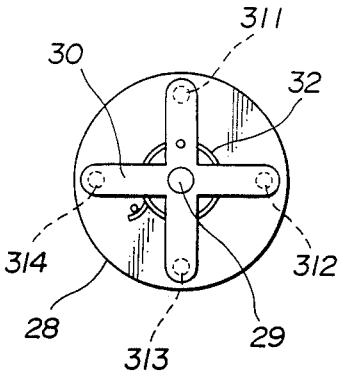
Figure 8B:
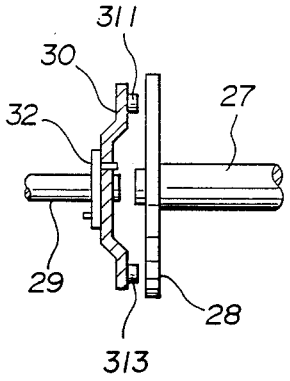

Further, in the construction according to the present invention, the rotational axis 27 of the disk 28 and the swing axis 29 of the swing member 30 are aligned to each other as stated above. Therefore, a multi-pole construction may be taken as shown in FIGS. 8(*a*) and (*b*) wherein a plurality of magnets 311 through 314 are disposed in the same plane of the swing member 30, but in a way not to interference to each other.

In such multi-pole construction, total amount of the electromagnetic foeces induced by the respective permanent magnets 311 through 314 are applied to the swing member 30, thereby readily increasing the swing torque on the swing member 30.

Figure 9:
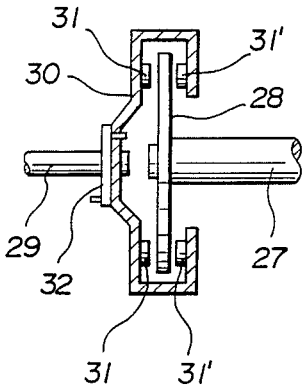
FIGS. 9 through 12 are side views each showing further embodiment of the engine governor device according to the present invention.

Referring to FIG. 9, a plural pairs of magnets 31 and 31′ opposed to each other between which the disk 28 is intervened are mounted on the swing member 30 with the same direction of the magnetic field obtained, thereby achieving the increased swing torque.

Figure 10:
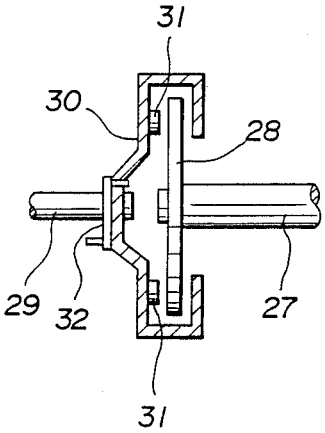

FIG. 10 represents a modified form of that shown in FIG. 9 wherein one of the magnets 31′ is omitted and instead a magnetic swing member 30 is bent to form a magnetic circuit which is opposed to the permanent magnet 31 through the intervention of the disk 28.

Figure 11:
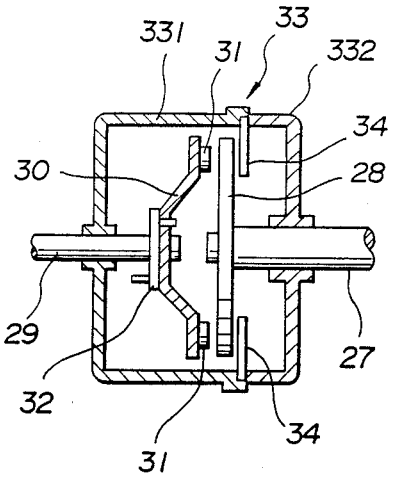

FIG. 11 represents a sealed construction according to the present invention wherein the disk 28 and the swing member 30 are enclosed in a housing 33.

In such construction, and eddy current is induced on the disk 28 under the influence of the permanent magnets 31 and the eddy current, together with the magnetic field of the permanent magnets 31, produces a electromagnetic force for moving the swing member 30 in the same manner as described above. It is to be noted here that if the disk 28 and the swing member 30 are not enclosed as in the embodiments described above, deposits of moisture and dust on to the disk 28 and the permanent magnets 31 may cause disturbance of the mechanical movement of the relevant portions and an occurrence of rust, resulting in a problem of change in magnetic characteristics. In addition, it is very important for the governor device to have highly precise gaps between the permanent magnets 31 and the disk 28 in order to produce the electromagnetic force for proper operation of the device.

Thus, by enclosing the disk 28 and the swing member 30 with the housing 33 to form the sealed construction as shown in FIG. 11, intrusion of the dust and moisture, as well as the disturbance of mechanical and magnetic operation as stated above can be prevented, thereby maintaining the precise gap between the disk 28 and the permanent magnet 31.

More particularly, with reference to FIG. 11, the housing 33 consists of two housing sections 331 and 332 at least one of which 331 is made of magnetic material and two housing sections 331 and 332 are jointed with intervening of magnetic piece 34 therebetween, which forms a magnetic circuit facing the permanent magnet 31.

Due to the housing section 332 adapted to be mounted on the rotational axis 27 having higher number of revolution, it is preferred that some suitable bearing is mounted between the rotational axis 27 and the housing 332.

Figure 12:
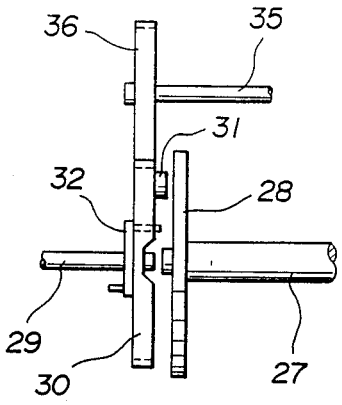
Figure 13:
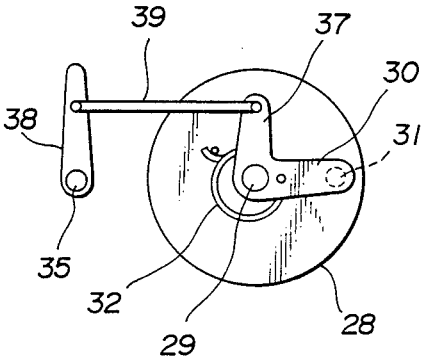
FIGS. 13 and 14 are plane views each showing further embodiment of the present invention.
Figure 14:
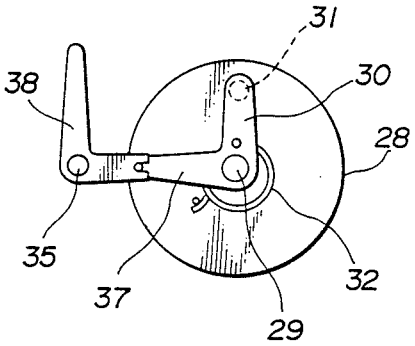

Alternatively, instead of the swing axis 29 of the swing member 30 used for the governor shaft, it is possible that the governor shafte 35 is disposed away form the swing axis 29 and motion of the swing member 30 is transmitted to the governor shaft 35 through the transmision mechanism such as a gear and a linkage as shown in FIGS. 12 through 14, respectively.

Referring to FIG. 12, a disk type swing member 30 is used and the peripheral portion thereof is provided with teeth to mesh the gear 36 mounted on the governor shaft 35. Referreing to FIG. 13, the swing member 30 has a link 37 provided integrally therewith, which is coupled to a rod 39. This rod 39 is then coupled to a link 38 which is mounted on the governor shaft 35. Referring to FIG. 14, a link 37 formed integrally with the swing member 30 and a link 38 mounted on the governor shaft 35 are coupled to each other by means of a pin.

Further an altenative arrangemeet may be taken in which motion of the swing member 30 is transmitted through the transmision mechanisms directly to the throttle shaft of the engine carburetor, rather than to the governor shaft as described above.

Figure 15:
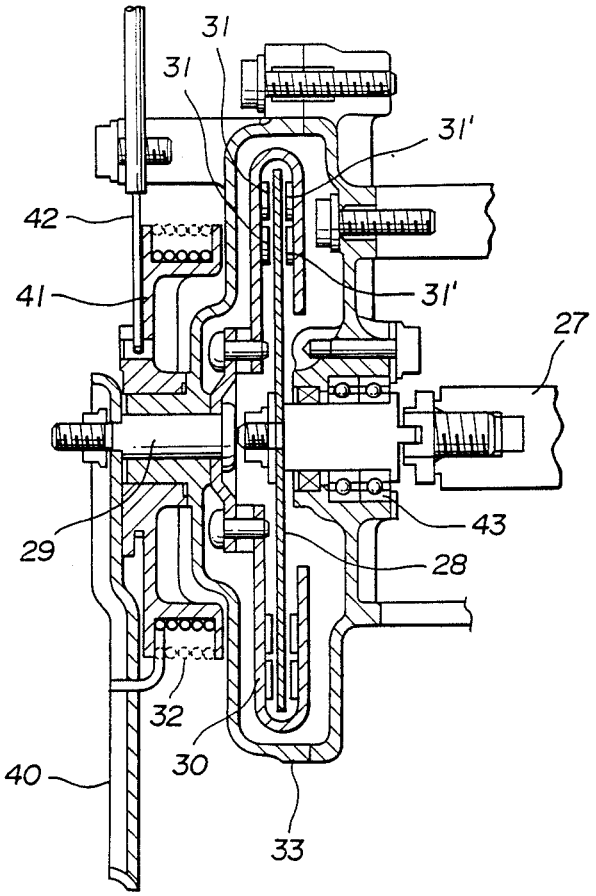
FIG. 15 is a side cross-sectional view showing a concrete form of the governor device according to the present invention.
Figure 16:
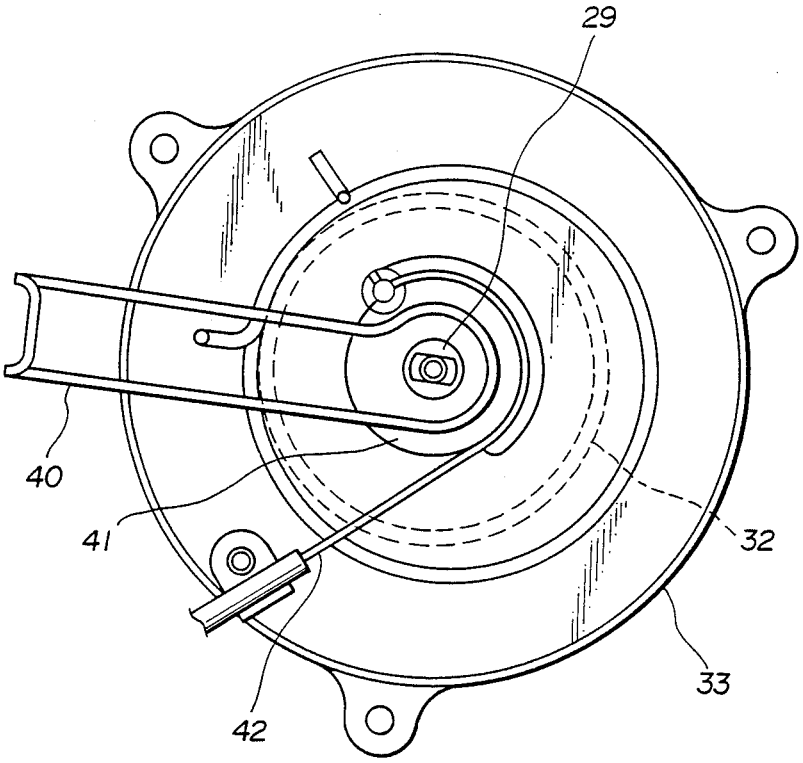
FIG. 16 represents the governor device shown in FIG. 15 as viewed from the governor arm thereof.
Figure 17:
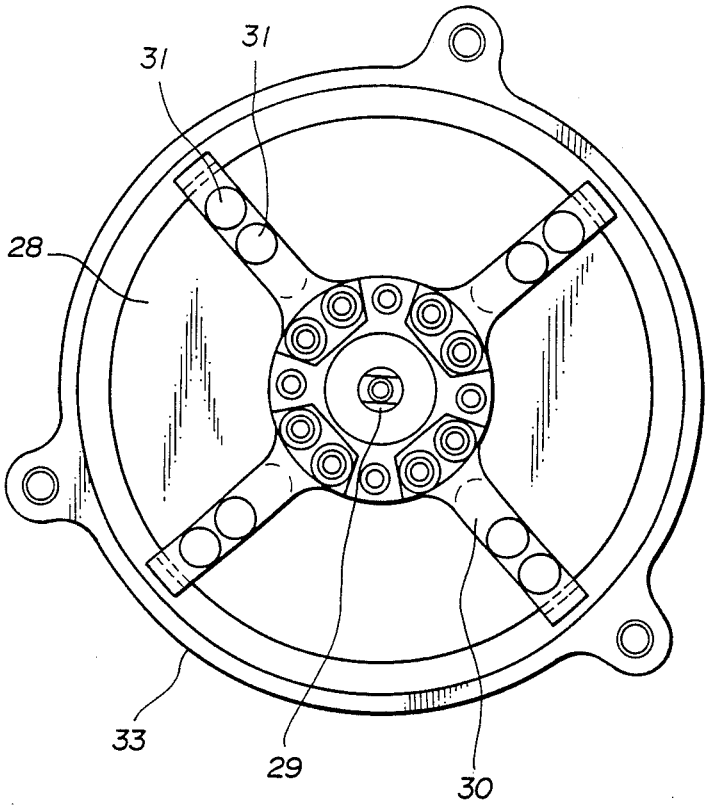
FIG. 17 is a plane view of the swing member as shown in FIG. 16.

FIGS. 15 through 17 represent typical examples of the governor device for an engine embodied in accordance with the present invention.

In such case, the swing axis 29 of the swing member 30 is used as the governor shaft and a governor arm 40 is attached thereto. In addition, there is mounted on the the portion of the swing axis 29, a swing member 41 which has a governor spring 32 attached thereto. One end of the governor spring 32 is connected to the governor arm 40 and other end of the spring 32 is connected to the stationary portion of the device so that a torque is transmitted from the governor arm 40 through the governor spring 32 to swing the swing member 41. Thus a control wire 42 is drawn to control the degree of opening for the engine throttle valve (not shown).

Furthermore, each arm of the swing member 30 in such multi-pole construction is provided with two sets of the permanent magnets 31, 31′ each set of which are opposed to each other with intervening of the disk 28.

The governor device according to the present invention as described above is incorporated into the engine of the overhead cam shaft type and can be effectively operated.

Figure 18:
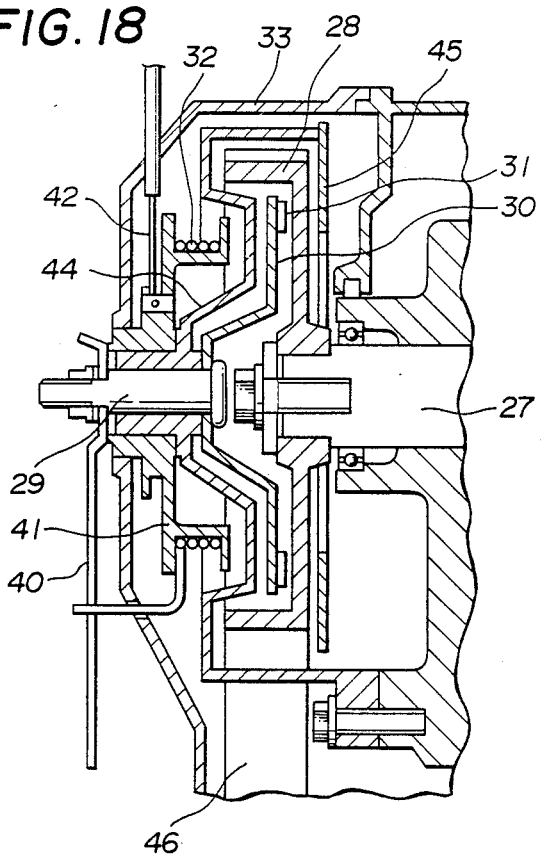
FIG. 18 is a side cross-sectional view showing further embodiment of the governor device of the present invention.

More precisely, with reference to FIG. 18, the engine of the overhead cam shaft type is shown, in which the cam shaft 27 is taken as the rotational axis and a cam pulley 28 attached on the cam shaft is taken as the disk. In the drawing, the reference numeral 46 represents a timing belt mounted around the cam pulley 28.

In such arrangement, it is not necessary for the rotational axis 27 and disk 28 to be separately provided which leads to reduced number of components of the device.

The cam pulley 28 is formed as cup shape and the swing member 30 of the multi-pole configuration is received in the inside concave portion of the cup.

The concave portion of the cam pulley 28 of the prior arrangemrnt was not effectively utilized and was considered as dead space. In accordance with the arrangement of the present invention, however, the effective utilization of the concave portion of the cam pulley is achieved as stated above so that the governor device of the present invention can be incorporated into the engine with minimun space occupied.

Figure 19:
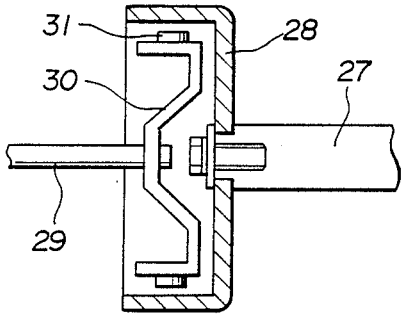
FIG. 19 is a side cross-sectional view showing other arrangement of the cam pulley and the swing member.

In FIG. 18, the permanent magnets 31 are secured to the swing member 30 such that they are opposed to the side surface of the cam pulley 28. Alternatively, it may be possible that as shown in FIG. 19, the permanent magnets are secured to the swing member 30 such that they are opposed to the internal peripheral surface of the cup shaped cam pulley 28.

Referring back to FIG. 18, the governor arm 40 is coupled to the swing axis 29 of the swing member 30 and there is mounted on the outer peripheral surface of the swing axis 29, a rotation member 41 which has a governor spring 32. One end of the governor spring 32 is coupled to the gvernor arm 40 and the other end of the spring is coupled to the stationary part of the device so that a torque is transmitted from the governor arm 40 through the governor spring 32 to rotate the rotation member 41. Then a control wire 42 which is connected to the rotation member 41 is withdrawn to rotate the throttle shaft through a link mechanism, for example, thereby adjusting the degree of opening for the throttle valve (not shown).

A frame 44 of the stationary part is formed by magnetic material such as iron and a magnetic member 45 is mounted on the frame 44 opposing to the premanent magnet 31 with the intervene of the cam pulley 28 to form a magnetic circuit.

In this embodiment, the cam pulley 28 consisting of the disk and the swing member 4 are housed in the housing 33 to form the sealed construction.

As an alternative, according to the present invention, the speed control of the engine can be achieved by such way that the swing action of the throttle axis is effected with linear torque characteristic rather than depending on the degree of opening of the throttle valve.

Figure 20:
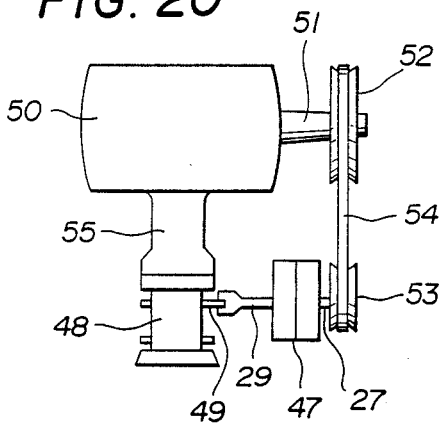
FIG. 20 represents, in simplified form, a further embodiment of the governor device of the present invention.
Figure 21:
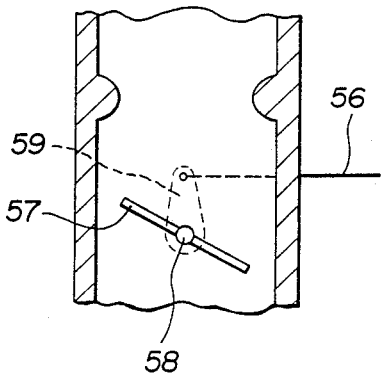
FIG. 21 represents driving means for the throttle axis of the conventional carburetor.
Figure 22:
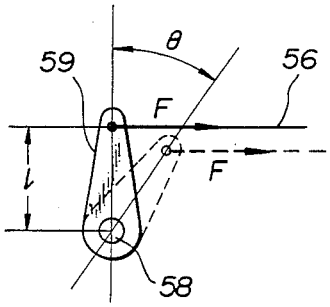
FIG. 22 represents the link mechanism for the throttle axis driving means for illustrating the operation thereof.

With reference to FIG. 20, such alternative embodiment of the present invention is shown wherein the governor device 47 is positioned so that the swing axis 29 of the governor device is aligned with the throttle axis 49 of the carburetor 48 and the both axes 29 and 49 are directly coupled to each other, thereby enabling direct rotation of the throttle axis 49 by means of the swing axis 29. In addition, a drive pulley 52 is mounted on the rotational axis 51 such as a crank axis, cam axis and balancer axis of the engine 50 and a driven pulley 53 is mounted on a rotational axis 27 of the governor device 47. Then a belt 54 is provided to extend around these pulleys 52 and 53 to transmit the rotation of the engine to the axis 27 of the governor device 47. A reference numeral 55 represents a intake manifold of the engine.

According to the arrangement as stated above, due to the fact that rotational force on the swing axis 29 of the governor device 47 is directly coupled to the throttle axis 49, the degree of opening of the throttle valve may be controlled in linear propotion to the number of revolution of the engine.

It is to be understand that a common drive mechanism such as a cam mechanism, rather than the belt/pulley mechanism as stated above, may be utilized in order to transmit the revolution of the engine to the rotational axis 27 of the governor device 47.

It is to be noted that although the present invention has been described with reference to several preferred embodiments, these are only illustrative purpose and the present invention is not limited to these embodiments. For example, with regarding to the mounting of the permanent magnet on the non-magnetic and electrically conductive disk for producing the electromagnetic force, in contrast to that described above, the permanet magnet may be mounted on a rotating member that is rotated in synchronism with the engine and non-magnetic and electrically conductive disk may be provided as a swing member.

It is apparent from the foregoings that the present invention provides an improved governor device for an engine that is simple in construction and easy to adjust and that achieves higher precision and stable control of engine speed with wider range of valve open/close stroke and of setting ability of drive force and without contacting the rotational portion of the engine, by utilizing an electromagnetic force induced by an influence of the magnetic field on the disk which is rotated in synchronism with the engine.

Further in the governor device according to the present invention, and electromagnetic force is induced on an non-magnetic and electrically conductive rotational member which is rotation in synchronism with the engine under the influence of magnetic field of the permanent magnet mounted on the swing member, or it is induced on a non-magnetic swing member under the influence of magnetic field of the permanent magnet mounted on the rotational member which is rotated in synchronism with the engine, thereby causing the swing action of the swing member against the governor spring to provide speed control of the engine. This is achieved, according to the present invention, in relatively simple construction wherein said rotational member and said swing member are positioned relative to each other so that rotational axis of the rotational member is aligned with the swing axis of the swing member. Therefore, the governor device arranged in such manner linearly controls the engine speed with higher precision and stability through the wide range of valve open/close stroke and of setting ability of drive force and without contacting the rotational portion of the engine.

In another arrangement where a cam shaft of the overhead cam shaft type engine has a pulley mounted thereon as the rotational member, the present invention provides an improved and effective governor device having the reduced number of components and facilitating assembly of the device to the engine itself.

In addition, according to the present invention said rotational member and said swing member are positioned so that the rotational axis of the rotational member and the swing axis of the swing member of aligned with the throttle axis of the carburetor throttle valve in order to open or close the valve, and the swing axis is directry coupled to the throttle axis so that the revolution of the engine is transmitted to the rotational axis of the rotational member through the rotation transmission mechanism. Thus such arrangement provides and advantage in that it enables the control of the engine speed so that the rotation of the throttle is linearly achieved instead depending upon the degree of opening of the throttle valve.

It will be apparent to those skilled in the art that further modification and variations can be made in the present invention. The invention in its broader aspects, therefore, is not limited to the specific details and illustrative examples shown and described. Accordingly, departure may be made from such details without departing from the spirit or scope of the general inventive concept.

What is claimed is:

1. A governor device for an engine characterized in that it comprises:

a non-magnetic and electrically conductive disk which is rotated in synchronism with the engine;

a swing member pivotally mounted for effecting a free-swing action thereof;

a magnet mounted on said swing member and providing a magnetic field onto said disk for inducing an electromagnetic force to effect said swing action of the swing member in responsive to the rotation of said disk;

a spring member for suppressing said swing action of said swing member in one direction; and a drive mechanism for operating a throttle valve of the engine in opening or closing direction in responsive to the swing action of said swing member.

2. A governor device for an engine according to claim 1 in which said engine is that used in a fly-wheel/-magnet type electric generator and said disk is mounted on a fly-wheel which is mounted on the engine crank shaft.

3. A governor device for an engine according to claim 1 in which said disk is mounted on the output shaft of the engine.

4. a governor device for an engine according to claim 1 in which a stator of said fly-wheel/magnet type generator for generating electric power in synchronism with the engine is pivotally mounted to effect the swing action under the electromagnetic force induced by the magnet on the wheel, the swing action of the stator in the same direction as that of the fly-wheel is suppressed by a spring member, and a drive mechanism is provided for operating the engine throttle valve in opening or closing direction in responsive to the swing action of the stator.

5. A governor device for an engine characterized in that an electromagnetic force is induced on a non-magnetic and electrically conductive rotational member which is rotated in synchronism with the engine under the influence of magnetic field of the premanent magnet mounted on the swing member, or it is induced on a non-magnetic swing member under the influence of magnetic field of the permanent magnet mounted on the rotational member which is rotated in synchronism with the engine, thereby causing the swing action of the swing member against the governor spring to provide speed control of the engine, and further said rotational member and said swing member are positioned relative to each other so that rotational axis of the rotational member is aligned with the swing axis of the swing member.

6. A governor device for an engine according to claim 5 in which a plurality of magnets are mounted on the swing member or the rotational member.

7. A governor device for an engine according to claim 5 in which said device is housed in a housing to form a sealed construction.

8. A governor device for an engine according to claim 5 in which said governor spring comprises a torsional spring wound around said swing axis of the swing member.

9. A governor device of an engine according to claim 5 in which said swing axis of the swing member is used as the governor shaft for effecting speed control of the engine.

10. A governor device for an engine according to claim 5 in which a motion for the swing axis of said swing member is transmitted through a drive transmission mechanism to the governor shaft for control of engine speed.

11. A governor device for an engine according to claim 5 in which said roational member comprises a cam pulley mounted on a cam shaft of an overhead cam shaft type engine and said cam pulley and the swing member are positioned so that the cam shaft is aligned with the swing axis.

12. A governor device for an engine according to claim 5 in which said rotational member and said swing member are positioned so that said rotational axis of the rotational member and said swing axis of the swing member are aligned with the throttle axis of the carburetor throttle valve, said swing axis is directly coupled to the throttle axis, and the rotation of the engine is transmitted through a rotation transmission mechanism to the rotational axis of the rotational member.

* * * * *